US006161246A

United States Patent [19]

Trachtenberg

[11] Patent Number: 6,161,246

[45] Date of Patent: Dec. 19, 2000

[54] BATHING IMPLEMENT

[75] Inventor: Steven Trachtenberg, Abington, Pa.

[73] Assignee: Verve, Ltd., Spring House, Pa.

[21] Appl. No.: 09/451,829

[22] Filed: Nov. 30, 1999

Related U.S. Application Data

[60] Provisional application No. 60/114,535, Dec. 31, 1998.

[51] Int. Cl.[7] ..... A47L 13/16; A47K 7/02

[52] U.S. Cl. ..... 15/229.13; 15/229.11; 15/209.1; D28/63; D32/40

[58] Field of Search ..... 15/244.4, 229.11, 15/229.13, 209.1, 104.94; D28/63; D32/40, 43

[56] References Cited

U.S. PATENT DOCUMENTS

| | | | |
|---|---|---|---|
| D. 100,569 | 7/1936 | Lewis . | |
| D. 351,285 | 10/1994 | Joyner et al. . | |
| D. 405,925 | 2/1999 | Badillo . | |
| 1,047,703 | 12/1912 | Rapson . | |
| 1,397,611 | 11/1921 | Bailey | 15/244.4 |
| 1,963,529 | 6/1934 | Protz . | |
| 2,581,779 | 1/1952 | Abraham . | |
| 3,281,884 | 11/1966 | Feil . | |
| 3,336,618 | 8/1967 | Day . | |
| 3,345,668 | 10/1967 | Forrest . | |
| 4,199,835 | 4/1980 | Heyer et al. . | |
| 4,462,135 | 7/1984 | Sanford . | |
| 5,144,744 | 9/1992 | Campagnoli | 29/446 |
| 5,465,452 | 11/1995 | Girardot | 15/229.11 |
| 5,650,384 | 7/1997 | Gordon | 15/244.4 |
| 5,713,094 | 2/1998 | Markey | 15/229.11 |
| 5,727,277 | 3/1998 | Chien | 15/209.1 |
| 5,727,278 | 3/1998 | Per-Lee | 15/229.11 |
| 5,787,542 | 8/1998 | Chien . | |
| 5,944,032 | 8/1999 | Masterson | 15/229.13 |
| 5,983,435 | 11/1999 | Osborne | 15/229.13 |
| 6,032,319 | 3/2000 | Garello | 15/229.11 |

FOREIGN PATENT DOCUMENTS

| | | | |
|---|---|---|---|
| 0630605 | 12/1994 | European Pat. Off. | 15/244.4 |

*Primary Examiner*—Randall E. Chin
*Attorney, Agent, or Firm*—Howson and Howson

[57] ABSTRACT

A combination bathing implement for use in cleansing and exfoliating skin and as a bath toy, or holder of soap or like products. The bathing implement includes a sponge component and a removable component. The sponge component can be, for instance, a ball-shaped mesh sponge, and the toy component can be, for instance, a water-friendly stuffed toy, a shaped solid soap product, or a container of a fluent soap, shampoo or lotion product. A loop component extends from the sponge component so that the other component is attachable to and removable from the sponge component. The loop component is appropriately sized so that it can be used as a handle to manipulate the sponge component during bathing. Alternatively, the implement can be utilized as a surface and article cleaning implement and be sold in combination with a container of cleaning product. The implement is also capable of being worn in a person's hair or as a bracelet around a person's wrist.

16 Claims, 5 Drawing Sheets

BATHING IMPLEMENT

This application claim benefits to provisional Application 60/114,535 filing date Dec. 31, 1998.

FIELD OF THE INVENTION

The present invention relates to a sponge type of implement having various uses, and more particularly, the present invention relates to an implement capable of use with soap during a bath or shower to cleanse and exfoliate skin.

BACKGROUND OF THE INVENTION

Most people utilize their hands, or a washcloth, to lather soap and apply the lathered soap to the body during bathing. More recently, sponges, netting or mesh material have been utilized as washcloths since they also provide an exfoliation function. Common mesh sponges are normally provided in a substantially ball-like shape and include a thin, elongate nylon string which enables the sponges to be hung until further use.

A common problem experienced with children, particularly young children, is that they often dislike bathing. One solution to this problem is the use of bath toys which help make a bath more enjoyable for the child. Another common problem is that young children often do not apply, or find it difficult to apply, a sufficient amount of lathered soap on their own to their bodies.

Although known washcloths, particularly washcloths intended for use by children, may be satisfactory for their intended purposes, there is a need for an improved bathing implement that sufficiently combines the activities of cleansing and playing.

OBJECTS OF THE INVENTION

With the foregoing in mind, a primary object of the present invention is to provide a bathing implement which can be used by children in a practical manner to cleanse and exfoliate skin.

Another object of the present invention is to provide a bathing implement which can be readily and effectively used by children, which can be easily grasped by the hand of a young child, and which is readily stored and dried by hanging it in the shower when not in use.

A further object of the present invention is to provide a toy that can be separated from the bathing implement so that it may be used within and outside the bath. Alternatively, in place of a toy, a standard bar of soap or specially molded soap-like product could be held by the bathing implement, or a container of liquid soap, shampoo, hand lotion or like product could be held by a loop component of the bathing implement.

A still further object of the present invention is to provide a bathing implement which provides an aesthetically pleasing bathing-area decoration so that a child-inviting atmosphere is created.

A still further object of the present invention is to provide a sponge type implement which can be utilized for a variety of purposes, for example, as a bathing implement, a cleaning implement, an implement that can be worn in a person's hair, and an implement that can be worn on a person's wrist or head.

SUMMARY OF THE INVENTION

More specifically, the present invention provides a bathing implement which includes a sponge component useful during a bath or shower to apply lather and/or exfoliate the skin of the bather. The sponge component is provided with an elastic loop, or ring, of mesh, terry cloth, taffeta, or like material which is appropriately sized to secure about a portion of a separate toy, soap, or container component so that the toy, soap or container component can be attached to and removed from the sponge component. If a toy component is utilized, preferably it is "water-friendly" and drys in a relatively quick period of time. Furthermore, when the toy, soap, or container component is removed, the bather can insert their hand, or a portion of their hand, through the elastic loop so that the loop functions as a handle and/or bracelet for ready and improved control and manipulation of the sponge component during washing. The implement can also be worn in a person's hair, around a person's wrist, or around a person's head.

BRIEF DESCRIPTION OF THE DRAWINGS

The foregoing and other objects, features and advantages of the present invention should become apparent from the following description when taken in conjunction with the accompanying drawings, in which.

DETAILED DESCRIPTION OF THE PREFERRED EMBODIMENT

Figure 2:
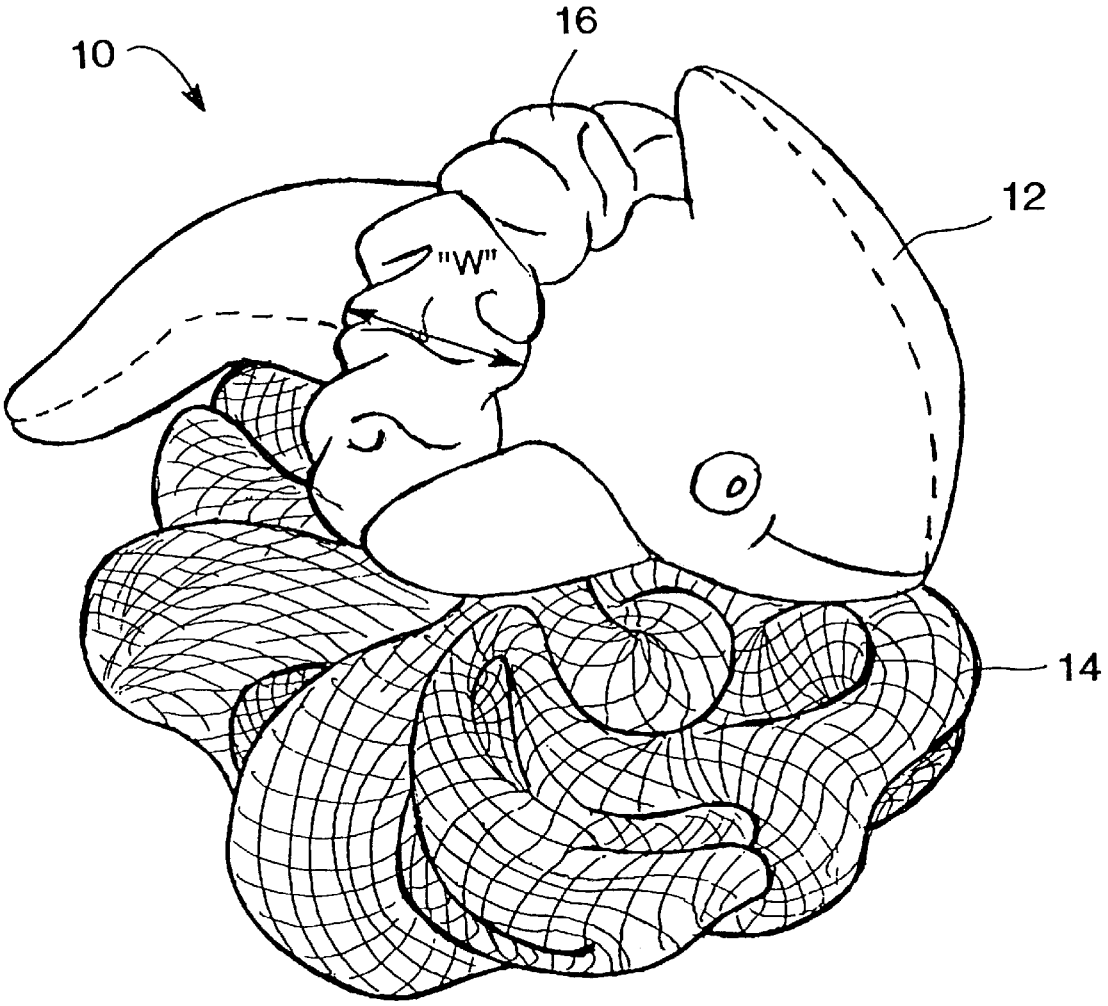
FIG. 2 is a perspective view of another embodiment of a stuffed toy according to the present invention attached to a sponge having an elastic band according to the present invention.
Figure 3:
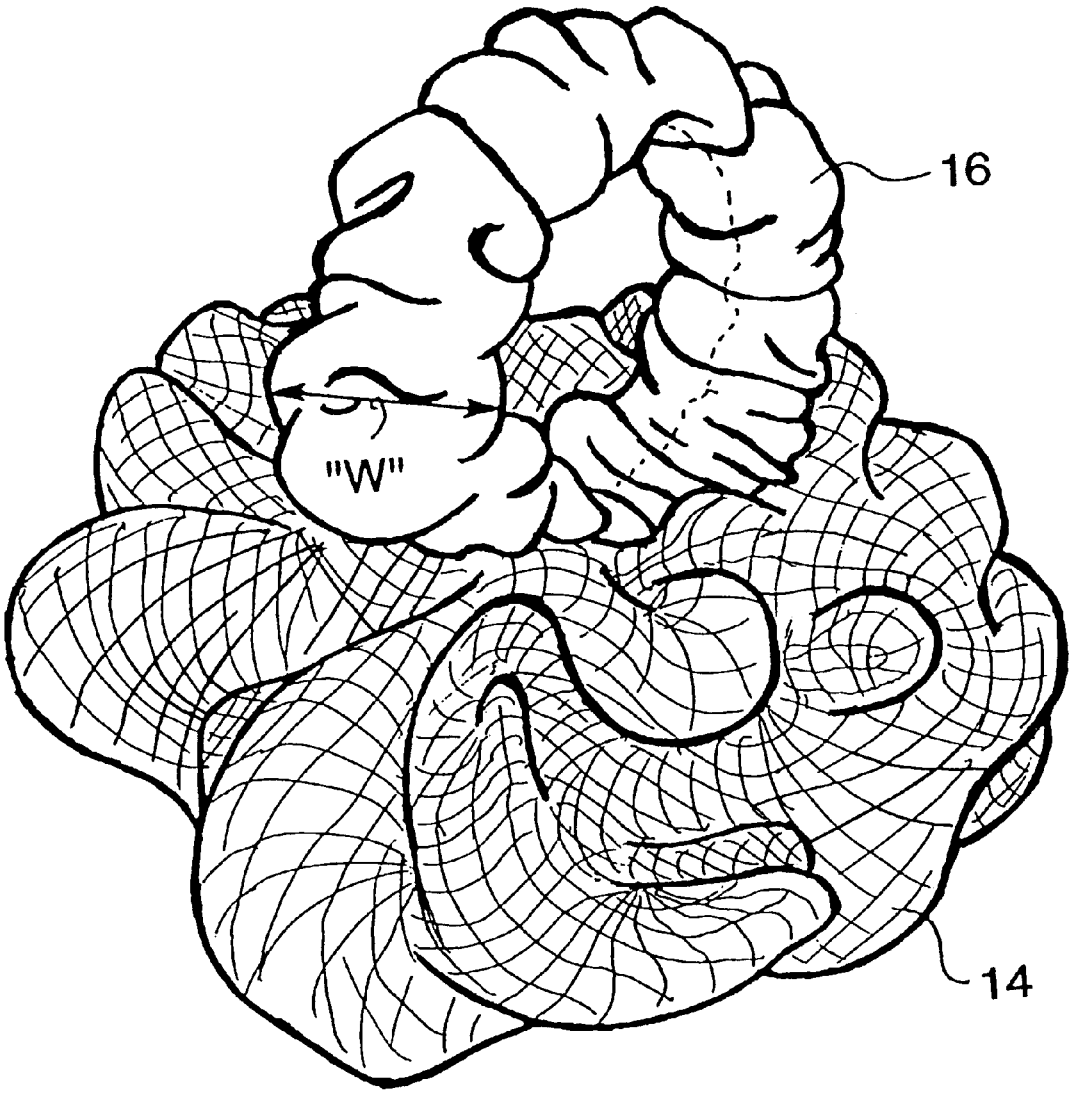
FIG. 3 is a perspective view of a bathing implement having a loop component according to the present invention.
Figure 4:
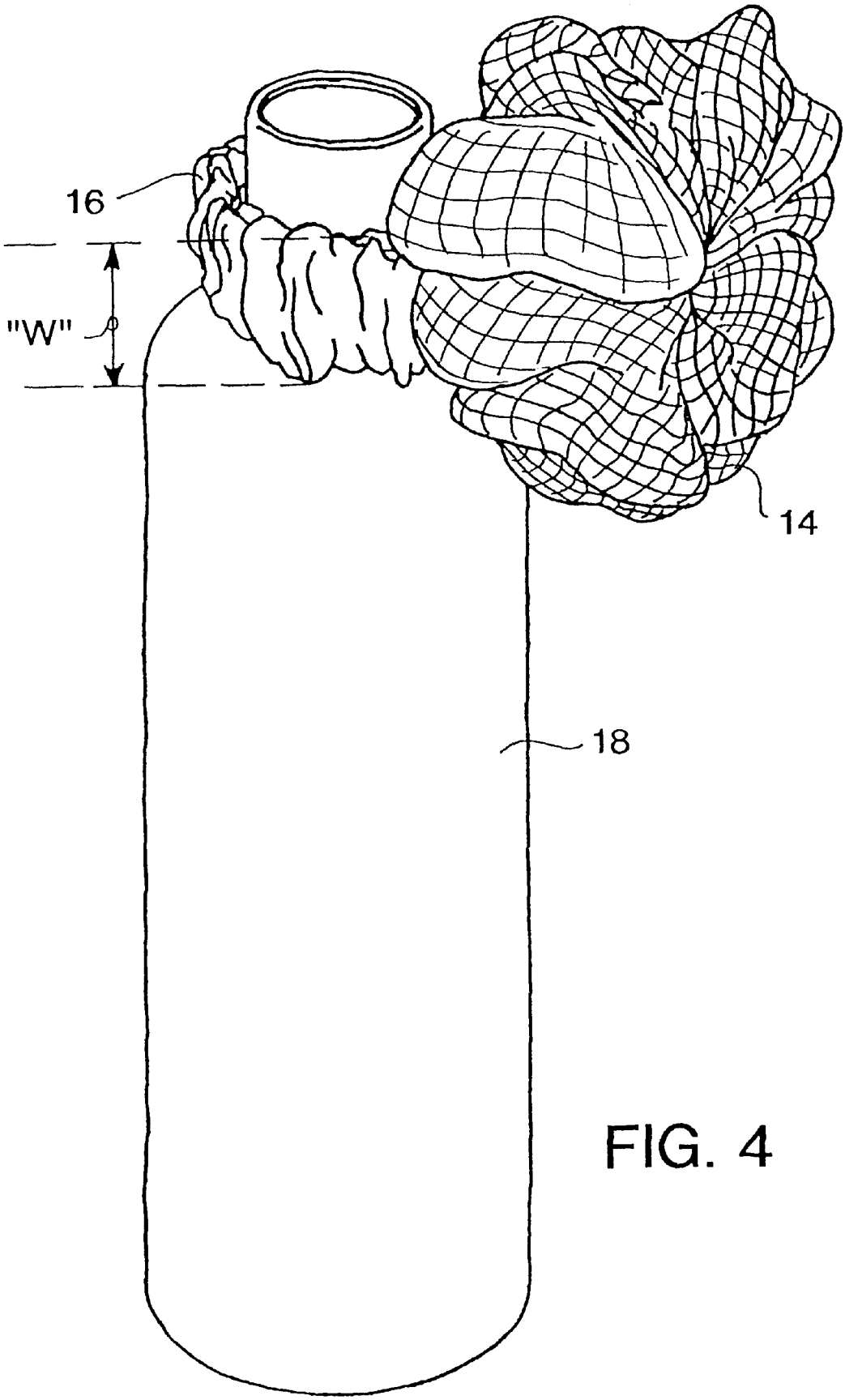
FIG. 4 is a perspective view of another embodiment of the bathing implement according to the present invention in combination with a container.
Figure 5:
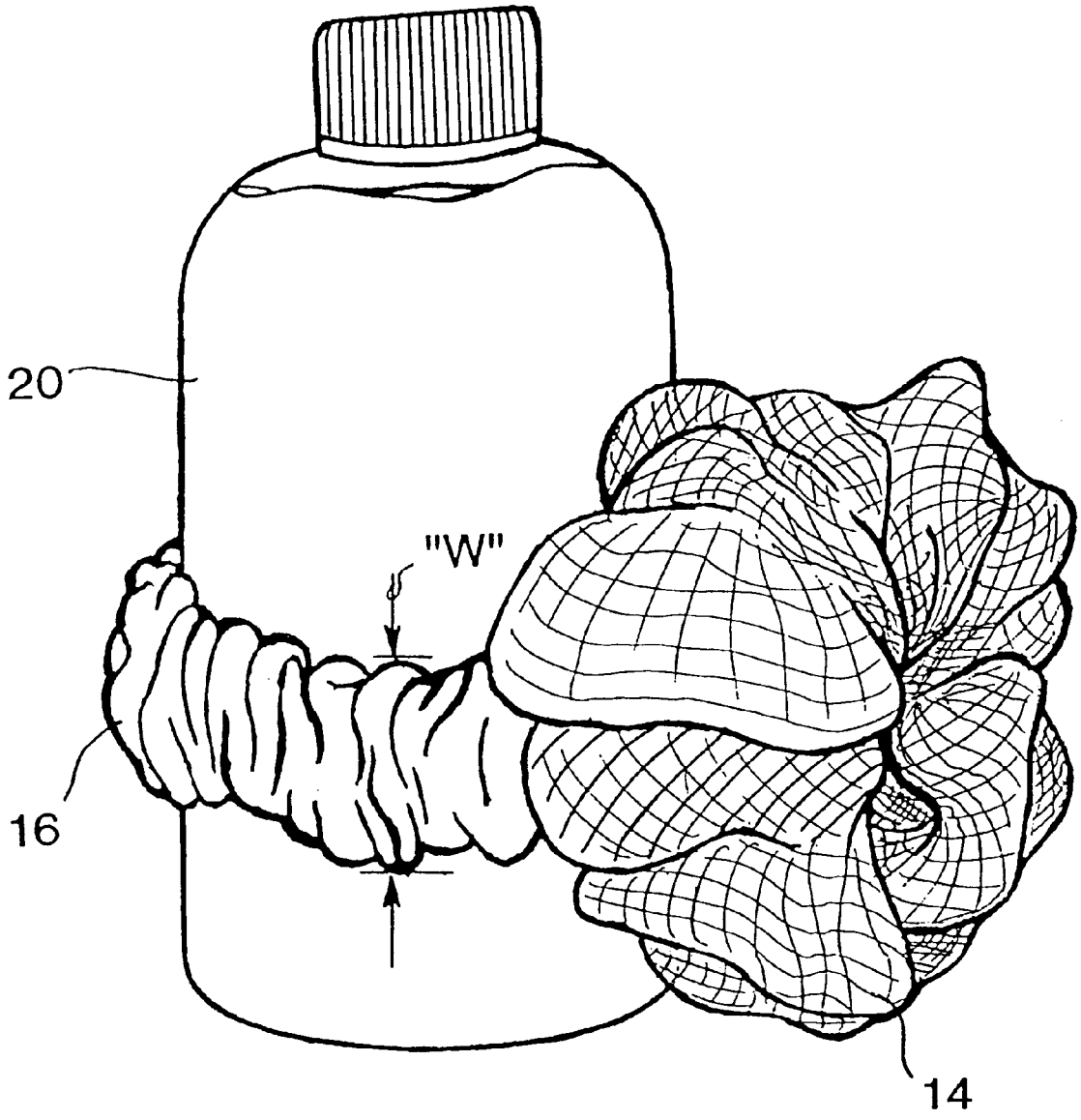
FIG. 5 is a perspective view of the bathing implement according to the present invention in combination with another container.

FIGS. 2 and 3 picture bathing implements 10 embodying the present invention. The bathing implement includes a toy component 12 a sponge component 14 and a loop component 16. The toy component 12 can be of, but not limited to, foam, polyester, PVC, terry cloth, soap, or like material, but is preferably made of a water-friendly polyester blend that can quickly dry. Alternatively, a standard bar of soap (not shown) or a container 18, 20 of liquid soap, shampoo or lotion, can be utilized in place of the toy component 12. Containers 18 and 20 are illustrated in FIGS. 4 and 5.

The sponge component 14 can be any type of, but not limited to, sponge, mesh, netting, terry cloth, PVA, cotton or like material, but is preferably a mesh sponge having a flexible ball-like shape as illustrated in FIG. 3. The loop component 16 can be any type of, but not limited to, mesh, tafetta, terry cloth, cotton, rubber, or like material. Preferably, the loop component 16 is elastic. Advertisements, company names, or like promotional material can be printed on the loop component 16 and correspond to the container 18, 20, toy 12 or other object utilized in combination with the bathing implement 10.

Figure 1:
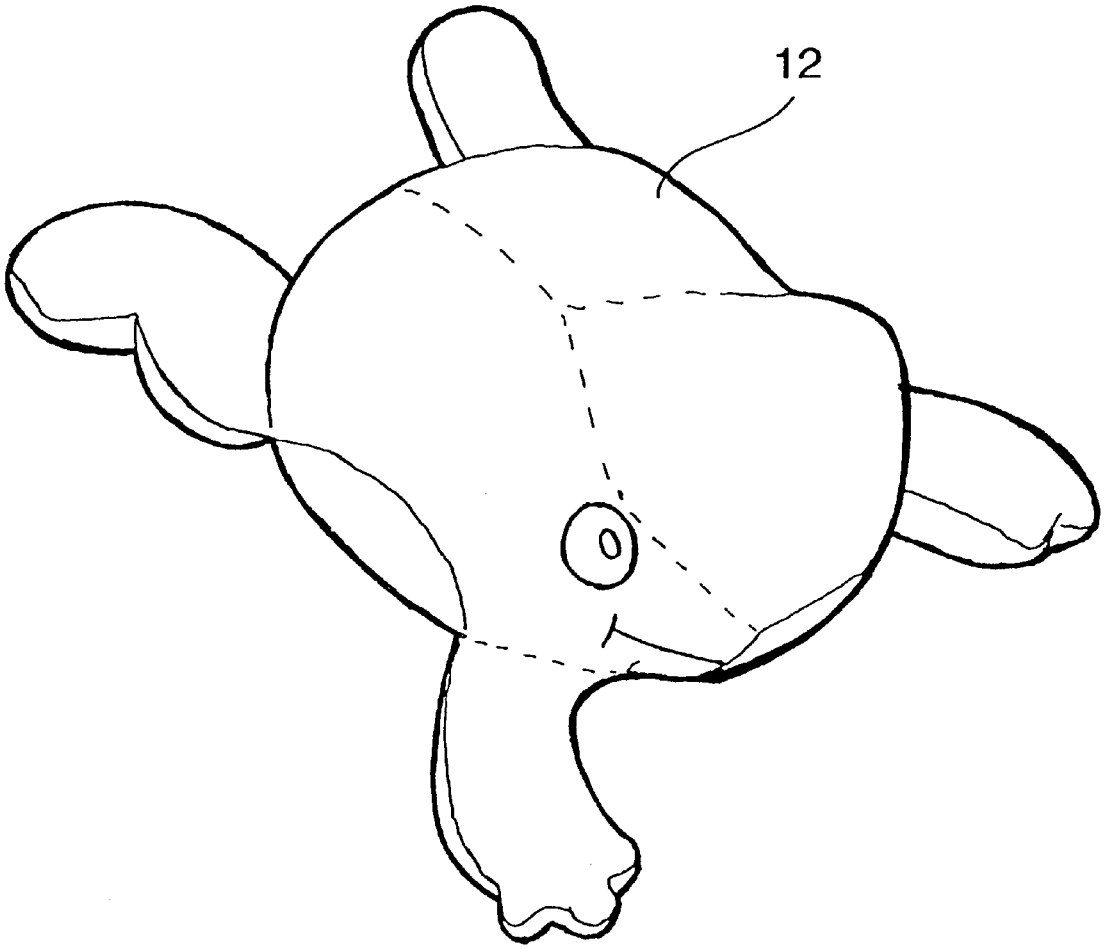
FIG. 1 is a perspective view of a decorative and playful staffed toy according to one embodiment of the present invention.

As pictured in FIG. 1, the toy component 12 provides decorative and playful features particularly attractive to young children. For instance, as pictured, the toy component 12 is provided in the shape of a frog. The frog could also be molded in the form of soap or be a container of liquid soap or like product. Alternatively, the toy component 12 can embody any other decorative or playful feature aesthetically pleasing to a child or other user. For example, the toy component 12 can be provided in the shape of other animals such as a shark as illustrated in FIG. 2.

As illustrated in FIGS. 1–3, the toy component 12 can be attached to and separated from the sponge component 14. To this end, the sponge component 14 is provided with a loop component 16. Preferably, the loop component 16 is permanently affixed to the sponge component 14 and extends outwardly therefrom. Thus, the toy component 12 can be removed from the sponge component 14 so that a child can play with the toy component 12 in or out of the bath tub, and so that the sponge component 14 can be utilized to apply lather to the skin of the bather. The toy and sponge components, 12 and 14, can thereafter be re-connected for play, storage, or drying purposes.

The loop component 16 provides multiple functions. It can be used to hang the bathing implement 10 for drying or storage purposes as is traditionally accomplished by the thin, elongate nylon cords of prior art mesh sponges. In addition, unlike the prior art cords, the loop component 16 of the present invention also functions to provide an attachment mechanism for the toy and sponge components, 12 and 14, and to provide a user-friendly handle which can be used to readily and easily manipulate the sponge component 14 during bathing. The later identified function of the loop component 16 is particularly important when the bathing implement is being utilized by a young child who otherwise may find it difficult to grasp, manipulate and use a ball-shaped sponge. The improved control of the sponge component 14 provided by the use of the loop component 16 results in improved cleaning of the bather which, again, is particularly important when the bather is a young child.

The loop component 16 can also be utilized to attach the implement 10 to containers 18 and 20 as illustrated in FIGS. 4 and 5, or to a person's wrist, head or hair. For example, the implement 10 can be utilized as a hair holder, such as a scrunchi, or it can be worn around a person's wrist as a bracelet. In addition, the implement can be worn as a part of a costume on a person's head by wrapping the loop component under a person's chin with the sponge component extending from the person's head. The sponge and loop components can be provided in different colors and textures depending on their intended purpose of use.

The loop component 16 is particularly shaped and sized to accomplish the above stated functions. Preferably, the loop component 16 is elastic and has a central aperture with a pre-determined dimension. The pre-determined dimension can be similar to the dimension of a medial portion of the toy component 12 and/or the typical dimension of a child's hand and/or wrist. For example, as pictured in FIG. 2, the loop component 16 snugly engages about the medial portion of the toy component 12 so that the toy component 12 is retained on the sponge component 14. In addition, the central aperture is also capable of snugly engaging a child's hand and/or wrist so that the bathing implement can be easily held by the child. By way of example and not by way of limitation, the central aperture of the loop component 16 can have a diameter of about 1 inch or greater, preferably about 1 to 3 inches. Larger sizes can be provided depending on the object used in combination therewith.

The loop component 16 is provided as a relatively wide band of material in comparison with the relatively thin, elongate nylon cords taught by the prior art. The width, W, of the loop component 16 permits the bathing implement to be easily grasped by small hands of young children and ensures that the toy component 12 is held to the sponge component 14 in a reliable manner. The width, W, of the loop component 16 permits use of the loop component 16 as a sponge for the purposes of applying lather to and exfoliating the skin of the bather. For example, the loop component 16 can be made of the same type of mesh netting material as the sponge components 14 or tafetta, or other like materials, so that the loop component 16 is equally useful in applying lather to, washing and exfoliating the skin of the bather. By way of example and not by way of limitation, the material used to form the loop component 16 can be provided with a width, W, of about 0.25 inch or greater, preferably about 0.25 to 2 inches.

Thus, the bathing implement according to the present invention provides a combination bathing sponge and removable toy, soap or container product. The toy, soap or container can be removed from the sponge. If a toy is utilized, it can be tossed or floated on the surface of the bath water, submerged and allowed to pop up out of the bath water, or played with before or after bath time. The removable component can be provided with an appearance which is particularly appealing to the specific bather, or a standard container/bottle of body wash, spritz, shampoo, etc. The sponge can be used with or without a soap product to wash and exfoliate the skin of the bather. The sponge is abrasive enough to dislodge dirt and grime from the body of the bather, yet at the same time, is soft enough to be used on sensitive skin. The loop component can be used as an attachment mechanism for the toy, soap or container component and the sponge component, as a handle for use in manipulating the sponge, as a means for hanging the bathing implement for drying or storage purposes, or as a sponge to wash and exfoliate the skin of the bather. Children can have their own personalized toy bathing implement for use during bath time which will create in the children a greater awareness of cleanliness and of the need to throughly wash their bodies. Finally, the invention is not limited to use by children; rather, different sized and shaped bathing implements can be used to accommodate adults, particularly if used in connection with a container as illustrated in FIG. 5.

The disclosed implement can also be utilized as a cleaning implement for cleaning kitchen surfaces, bathroom surfaces, pots and pans, sinks, and other similar surfaces and articles. The loop component provides a handle for engaging the cleaning implement during use and can be sold in combination with a bottle/container of cleaning liquid, gel or powder. To this end, the loop component can be looped around the sidewall of the container of cleaning product to provide an efficiently packaged cleaning product and applicator combination.

While preferred combination bathing implement has been described in detail, various modifications, alterations, and changes may be made without departing from the spirit and scope of the present invention as defined in the appended claims.

What is claimed is:

1. A bathing implement comprising:

a substantially ball-shaped sponge component for use in applying lather to cleanse a bather;

a loop component attached to and extending from said sponge component for use as a handle to manipulate said sponge component when said sponge component is used to apply lather to cleanse the bather, said loop component having a central aperture; and a removable water friendly stuffed toy of a predetermined size held in a snug manner within said central aperture of said loop component.

2. A bathing implement according to claim 1, wherein said toy has a medial portion of a size which is removably held by said loop component and end portions which extend opposite and adjacent to said medial portion and which extends laterally outwardly to a greater extent than said medial portion.

3. A bathing implement according to claim 1, wherein said central aperture has a diameter of between about 1 inch to about 3 inches.

4. A bathing implement according to claim 3, wherein said loop component is formed by a band of material having a width of between about 0.25 inch to about 2 inches.

5. A bathing implement according to claim 4, wherein said band of material displays printed promotional indicia.

6. A bathing implement according to claim 4, wherein said loop component is elastic and stretchable.

7. A bathing implement according to claim 6, wherein said loop component has an outer layer of material selected from the group consisting of tafetta, terry cloth, cotton and rubber.

8. A bathing implement according to claim 7, wherein said outer layer of material having indicia displayed thereon for providing promotional information.

9. A bathing implement comprising:

a substantially ball-shaped sponge component for use in applying lather to cleanse a bather;

a loop component attached to and extending from said sponge component for use as a handle to manipulate said sponge component when said sponge component is used to apply lather to cleanse the bather, said loop component having a central aperture; and a removable container having a predetermined size held in a snug manner within said central aperture of said loop component.

10. A bathing implement according to claim 9, wherein said container is selected from the group consisting of a liquid soap container, shampoo container, lotion container and cleaning product container.

11. A bathing implement according to claim 9, wherein said central aperture has a diameter of between about 1 inch to about 3 inches.

12. A bathing implement according to claim 11, wherein said loop component is formed by a band of material having a width of between about 0.25 inch to about 2 inches.

13. A bathing implement according to claim 12, wherein said band of material displays printed promotional indicia.

14. A bathing implement according to claim 11, wherein said loop component is elastic and stretchable.

15. A bathing implement according to claim 14, wherein said loop component has an outer layer of material selected from the group consisting of tafetta, terry cloth, cotton and rubber.

16. A bathing implement according to claim 15, wherein said outer layer of material having indicia displayed thereon for providing promotional information.

* * * * *